US006443738B2

(12) United States Patent
Yamanashi et al.

(10) Patent No.: US 6,443,738 B2
(45) Date of Patent: Sep. 3, 2002

(54) WIRING UNIT

(75) Inventors: Makoto Yamanashi; Takao Murakami; Hiroyuki Suzuki, all of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/879,174

(22) Filed: Jun. 13, 2001

(30) Foreign Application Priority Data

Jul. 19, 2000 (JP) ..... 2000-218950

(51) Int. Cl.[7] ..... H01R 29/00
(52) U.S. Cl. ..... 439/45; 439/399
(58) Field of Search ..... 174/70 B, 197, 174/168; 439/45, 397, 399, 949, 404

(56) References Cited

U.S. PATENT DOCUMENTS 3,627,942 A * 12/1971 Bobb ..... 439/45
5,122,077 A * 6/1992 Maejima et al. ..... 439/398
5,139,434 A * 8/1992 Goodman ..... 439/399
5,683,268 A * 11/1997 Drach et al. ..... 439/404
5,879,181 A * 3/1999 Okabe ..... 439/397

* cited by examiner

*Primary Examiner*—Dean A. Reichard
*Assistant Examiner*—Adolfo Nino
(74) *Attorney, Agent, or Firm*—Armstrong, Westerman & Hattori, LLP

(57) ABSTRACT

A wiring unit 1 includes a plurality of crimping terminals 2; and a plurality of insulating plates for holding said crimping terminals. The insulating plate 2 has a terminal groove 5 concaved from the surface, an accommodating portion 6 and a through-hole 7. The accommodating portion 6 is formed in concave from one of a pair of partition walls 9*a* and 9*b* constituting the terminal accommodating groove 5. The through-hole 7 passes through the insulating plate 2 and communicates with the accommodating portion 6. The crimping terminal 3 is composed of the electric-wire connecting portion 13 on which the electric wire is crimped and an electric-wire connecting portion 14. The insulating plates 2 are stacked while holding the crimping terminals 3. The electric contact portions 14 of the crimping terminals 3 held in the adjacent lower and upper insulating plates 2 are not superposed. The electric contact portion 14 of the crimping terminal 3 held in the lower insulating plate 2 is accommodated in the accommodating portion 6 via the through-hole 7 of the upper insulating plate 2. In this configuration, the wiring unit can be miniaturized.

3 Claims, 4 Drawing Sheets

WIRING UNIT

BACKGROUND OF THE INVENTION

1. Field of the Invention

This invention relates to a wiring unit housed in an electric connecting box mounted in a motor vehicle that is a moving body.

2. Description of the Related Art

The motor vehicle is generally provided with a variety of electronic appliances inclusive of lamps such as a head lamp, tale lamp, etc. motors such as a starter motor, a motor for an air conditioner, etc.

In order to supply power to the variety of electronic appliances, junction blocks are located at suitable position within the motor vehicle. The junction block is configured so that printed boards and wiring boards with elements such bus bars are stacked and various electric circuit units such as a large number of fuses, relays, etc. are integrated on these wiring boards.

The junction block may includes a fuse, relay, bus bar, etc. so that it is called a fuse block, relay box, or generally an electric connecting box. In this specification, the above fuse block, relay box, junction block, etc, are referred to as the electric connecting box.

The electric connecting box includes a case and a wiring plate, etc. The case can be provided with electric components such as a relay, fuse, connector. A plurality of electric wires connected to the various electric appliances are led into the case. The wiring plate, when it is housed in the case, electrically connects the electric wires connected to the various electric appliances to terminals of the various electric components in a prescribed pattern.

As the above wiring plate, in order to facilitate the connection of the respective electric wires to the terminals of the electric components, a wiring unit 54 as shown in FIG. 6 has been proposed. The wiring unit as shown in FIG. 6 includes a plurality of boards 61 which are stacked successively, a plurality of terminals 62 and a plurality of connecting bars 63.

The boards 61 each is made of an insulating material. The boards 61 each is formed as a square flat plate. The boards 61 each includes a plurality of grooves 64, a plurality of concave portions 65 and a plurality of holes 66. The grooves 64 each is formed in concave from the surface of the board 61. The grooves 64 each extends in a longitudinal direction of the board 61. The respective grooves 64 are formed in parallel to one another.

The concave portions 65 each is formed in concave from the surface of the board 61. The concave portions 65 each is opened into the groove 64. The concave portions 65 are provided in parallel to one another in the longitudinal direction of the corresponding groove 64. The concave portions 65 are formed in the one wall 74 of two walls 74 and 75. The concave portions 65 each is formed in a square shape when viewed from above.

The holes 66 each passes through the portion located at the bottom of the corresponding concave portion 65. The holes 66 are located at the corresponding positions when the boards are stacked successively.

The terminals 62 each is made from a metallic sheet. The terminal 62 is composed of an electric contact portion 67 and an electric-wire connecting portion 68. The electric contact portion 67 is adapted to be received in the above connecting bar 63. When the connecting bar 63 is received in the electric contact portion 67, it produces elastic restitutive force that impedes the insertion of the connecting bar 63 so that the relative position of the connecting bar 63 to the electric contact portion 67 is maintained.

The electric-wire connecting portion 68 permits an electric wire (FIG. 6) to be arranged unidirectionally. The electric-wire connecting portion 68 includes a crimping segment 70 on which the electric wire 69 can be crimped and a pair of electric-wire holding segments 71 which are located at the positions where the electric wire 69 is sandwiched in the direction of arranging the electric wire 69.

The crimping segment 70 is provided with press-fitting blades 72, which cut the coating of the electric wire 69 to come in contact with the core thereof. The electric wires each is provided with a pair of caulking pieces 73 between which the electric wire 69 with the coating is caulked. The caulking pieces 73 sandwiches the electric wire 69 therebetween so that the contact state of the press-fitting blades 72 of the crimping portion 70 and the core is maintained.

The electric contact portion 67 and the electric-wire connecting portion 68 are arranged at the positions where the electric wire 69 is not impeded. Specifically, in the direction of arranging the electric wire 69, the electric connecting portion 67 is arranged to intersect the electric-wire connecting portions 68.

The terminal 62 connects the electric wire 69 crimped on the crimping portion 70 or electric-wire connecting portion 68 and the connecting bar 63 inserted into the electric contact portion 67 to each other. The terminal 62 is attached to the board 61 in a state where the electric contact portion 67 is housed in the concave portion 65 and the electric-wire connecting portion 68 is housed in the groove 64.

The connecting bar 63 is made of a conductive material. The connecting bar 63 is formed in a band shape. The connecting bar 63, when inserted into the hole 66 and the electric connecting portion 67 of the terminal 62, is electrically connected to the electric wire 69.

In the wiring unit having the configuration described above, the electric wires 69 connected to various electric appliances are arranged in the grooves 64. By stacking a plurality of boards 61 and optionally selecting the concave portions 65 and holes 66, the electric wires 69 are electrically connected to the relay, fuse, connector, etc. mounted in the above case according to a prescribed pattern.

In the wiring unit shown in FIG. 6, the concave portions 65 are formed on the one wall surface 74 of the two wall surfaces 74 and 75. Therefore, as seen from FIG. 8, the electric contact portions 67 of the terminals 62 held in the stacked boards 61 are superposed successively. The height of the terminal 62 is generally defined by the height of the electric contact portion 67.

Therefore, in the wiring unit 54, necessity of making the thickness of the board 61 thicker than the height of the electric contact 67 arises so that it is difficult to downsize the wiring unit 54 in the direction of the thickness of the board 61. In short, it is difficult to miniaturize the wiring unit 54.

SUMMARY OF THE INVENTION

An object of this invention is to provide a wiring unit which can be miniaturized.

In order to attain the above object, in accordance with this invention, there is provided a wiring unit comprising:

a plurality of crimping terminals; and a plurality of insulating plates for holding the crimping terminals, wherein the crimping terminals each includes an electric-wire connecting portion on which an electric wire is crimped and an electric contact portion to be connected to another electric contact portion, and the plurality of insulating plates are stacked successively, and the crimping terminals each is held in each the insulating plates so that the electric contact portions in at least every other insulating plate are superposed.

In this configuration, the plurality of insulating plates are stacked successively, and the crimping terminals each is held in each the insulating plates so that the electric contact portions in at least every other insulating plate are superposed. Therefore, the electric contact portions of the crimping terminals held in the adjacent insulating plates do not superposed on each other. Accordingly, even where the thickness of the insulating plate is decreased to the height of the electric-wire connecting potion which is thinner than the height of the electric contact portion, the insulating plates can be surely stacked. This contributes to miniaturization of the wiring unit.

Preferably, the insulating plates each has a through-hole which the electric contact potion of the crimping terminal held in an adjacent insulating plate can enter when the insulating plates are stacked successively. In this configuration, the electric contact portion of the crimping terminal held in the other insulating plate can be inserted into the terminal groove through the through-hole. Therefore, even where the thickness of the insulating plate is decreased to the height of the electric-wire connecting potion which is thinner than the height of the electric contact portion, the insulating plates can be surely stacked. This also contributes to miniaturization of the wiring unit.

Preferably, the electric wire connecting portion crimps the electric wire in a state extended in a first direction, and the electric contact portion is arranged in a second direction orthogonal to the the first direction, and the insulating plate includes a terminal groove for accommodating the crimping terminals in a state where they are arranged side by side in the first direction, and accommodating portions which are formed in concave from a pair of opposite wall surfaces constituting the terminal groove and can accommodate the electric contact portions, respectively.

In this configuration, in one of the adjacent insulating plates, the electric contact portion can be accommodated in the accommodating portion concaved from the one side wall, whereas in the other thereof, it can be accommodated in the accommodating portion concaved from the other side wall. This prevents the electric contact portions of the crimping terminals held in the adjacent insulating plates from being superposed on each other. Therefore, even where the thickness of the insulating plate is decreased to the height of the electric-wire connecting potion which is thinner than the height of the electric contact portion, the insulating plates can be surely stacked. This also contributes to miniaturization of the wiring unit.

The above and other objects and features of the invention will be more apparent from the following description taken in conjunction with the accompanying drawings.

DESCRIPTION OF THE PREFERRED EMBODIMENTS

Embodiment 1

Figure 1:
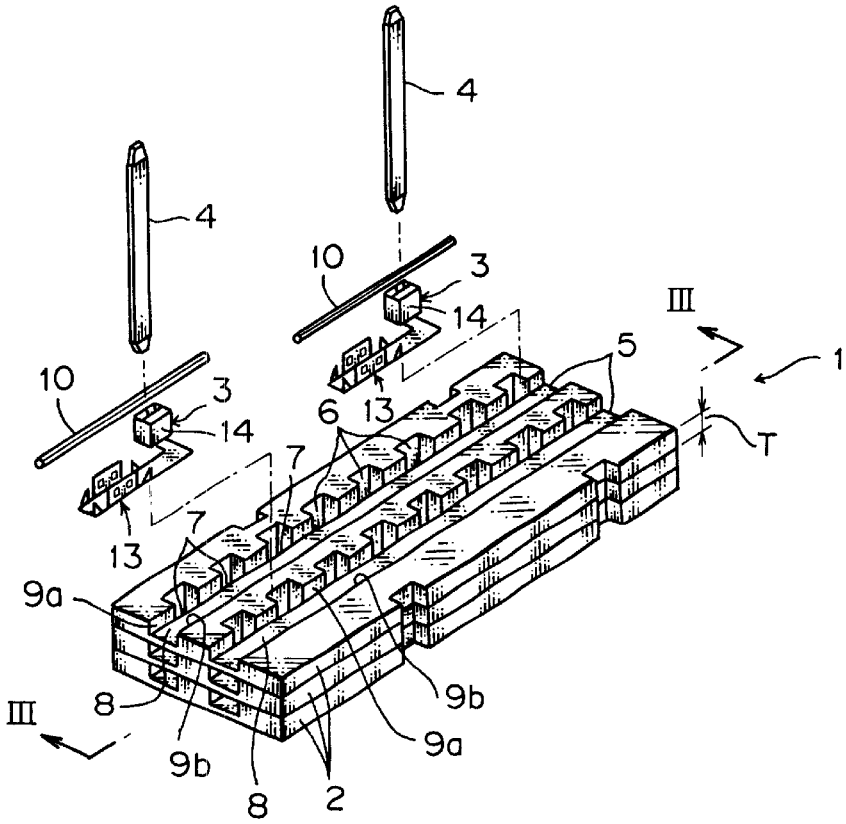
FIG. 1 is a perspective view of a wiring unit according to a first embodiment of this invention.
Figure 2:
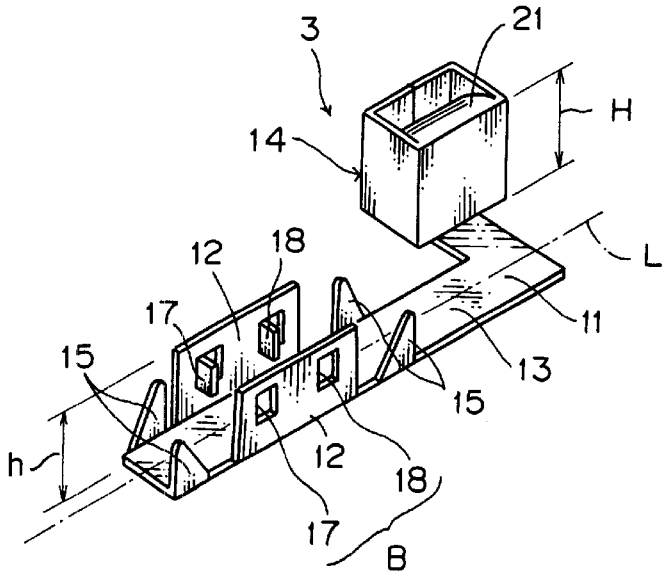
FIG. 2 is a perspective view of a crimping terminal of the wiring unit according to the first embodiment.
Figure 3:
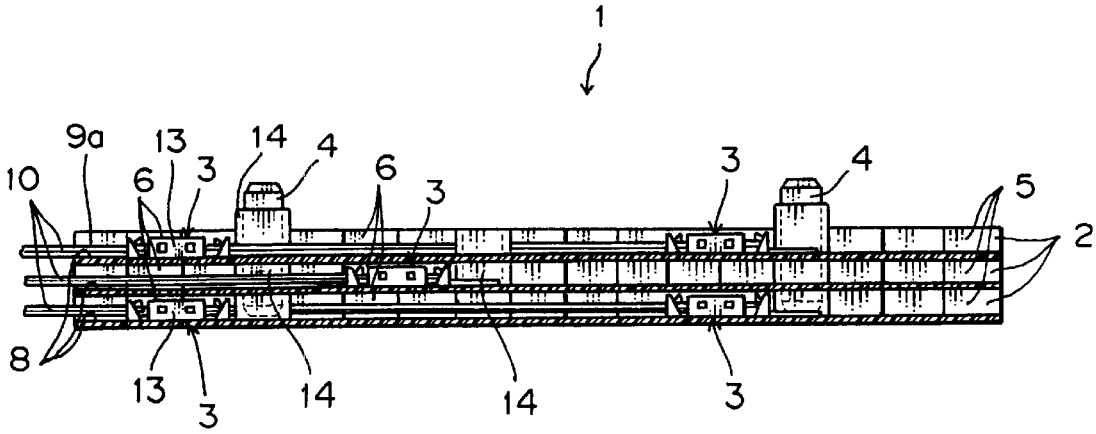
FIG. 3 is a sectional view taken in line III—III in FIG. 1.

Referring to FIGS. 1 to 3, an explanation will be given of a wiring unit according to the first embodiment of this invention.

As seen from FIG. 1, the wiring unit 1 includes a plurality of insulating plates 2 which are stacked successively, a plurality of crimping terminals 3 and a plurality of connecting bars 4. The insulating plates 2 each is made of an insulating material. The insulating plates 2 each is formed as a square flat insulating plate. The insulating plates 2 each includes a plurality of terminal accommodating grooves (hereinafter referred to simply "grooves") 5, a plurality of accommodating portions and a plurality of through-holes 7.

The grooves 5 each is formed in concave from the surface of the insulating plate 2. The grooves 5 each extends in a longitudinal direction of the insulating plate 2.

The respective grooves 5 are formed in parallel to one another. The grooves 5 each is composed of a bottom 8 along the surface of the insulating plate 2 and a pair of wall surfaces 9*a* and 9*b* which are communicated with the bottom 8 and the surface of the insulating plate 2 and spaced apart from each other. Incidentally, only two grooves 5 are formed on the insulating plate 2. The accommodating portions 6 are formed in concave from the one wall surface 9*a* so that the interval between the pair of wall surfaces 9*a* and 9*b* is increased. The accommodating portions 6 are provided in parallel to one another in the longitudinal direction of the corresponding groove 5. Eight accommodating portions 6 are formed for the one groove 5. The accommodating portions 6 each is formed in a square shape when viewed from above.

The through-holes 7 each passes trough the insulating plates 2 to communicate with corresponding accommodating portions 6. The electric contact portion 14 of the crimping terminal 3 can advance into the through-hole 7. In the example as shown, when viewed from above, the through-hole 7 is formed to coincide with the corresponding accommodating portion 6.

The interval between the bottom and front surface of the insulating plate 2, i.e. the depth of the groove 5 is set to be equal to or slightly larger than the height h (FIG. 2) of the electric wire connecting portion of the crimping terminal 3. The insulating plate 2 has a thickness (FIG. 1) equal to that of the above height h.

The crimping terminal 3 is formed by bending a conductive metallic sheet. As seen from FIG. 2, the crimping terminal 3 is composed of a flat wall 11 on which an electric wire is placed, a pair of side walls 12, an electric-wire connecting portion 13 and an electric contact portion 14.

The wall 11 is belt-shaped. The pair of side walls 12 are also belt-shaped, respectively. The pair of side walls 12 are communicated with both edges in the axial direction of the flat wall 11. The pair of side walls 12 are extended upright from the flat wall 11, respectively.

The electric-wire connecting portion 13 includes two pairs of caulking pieces 15 and two pairs of press-fit blades 17, 18. The pair of caulking piece 15 are communicated with both edges in the axial direction of the flatwall 11 and opposite to each other. The pair of caulking pieces 15 are extended upright from the flat wall 11, respectively.

The press-fitting blades 17, 18 are extended upright from the flat wall 11. The press-fitting blades 17, 18 are protruded in a direction of the pair of sidewalls 12 approaching each other from the inner faces thereof.

The caulking pieces 15 hold the electric wire 10 (FIG. 1) in such a manner that it is bent to hang over the flat wall 11. Namely, the caulking pieces 15 caulk the electric wire. The press-fitting blades 17, 18 incise the coating of the electric-wire 19 press-fit therebetween so that they are brought into contact with the core, thereby assuring its electric connection to the electric wire 10.

Thus, the electric wire 10 is crimped on electric-wire connecting portion 13. Specifically, the electric wire 10 is crimped on the electric-wire connecting portion 13 in a direction indicated by one-dot chain line L in FIG. 2. The electric-wire connecting portion 13 is held in the corresponding groove 5.

The electric contact portion 14 is formed in a square cylinder and is communicated with the one edge of the flat wall in the width direction. Namely, the electric contact portion 14 is arranged in a direction orthogonal to the one-dot chain line L.

The electric-contact portion 14 is accommodated in the accommodating portion 6 so that its hole is communicated with the through-hole of the insulating plate 2. Within the hole of the electric contact portion 14, a connecting spring piece 21 to be brought into contact with the connecting bar 4 is provided. The connecting bar 4 is made of a metallic belt. The connecting bar 4 is to be inserted into the hole of the electric contact portion 14.

When the insulating plates 2 are stacked successively, the connecting bar 4 is inserted in the hole of the square cylinder. In this way, the electric contact portion 14 electrically connects the crimping terminals held in the corresponding insulating plates 2 and superposed on each other.

The wiring unit 1 will be assembled as follows. First, the electric-wire connecting portions 13 are press-fit in the corresponding grooves 5, respectively and the electric contact portions 14 are press-fit in the accommodating portions 14, respectively. Thus, the crimping terminals 3 are held in the corresponding positions of the insulating plates 2.

In this case, as seen from FIG. 3, the crimping terminals 3 are held in the insulating plates 2 so that the electric contact portions 14 of the crimping terminals 3 when the insulating plates 2 are stacked successively are not superposed on each other. On the other hand, the crimping terminals 3 are held in the insulating plate 2 so that the electric contact portions 14 in at least every other insulating plate are superposed. As seen from FIG. 3, the electric contact portion 14 held in a lower insulating plate 2 invade the accommodating portion 6 through the through-hole 7 of the upper insulating plate 2.

In the example as shown in FIG. 3, the crimping terminals 3 are held in the insulating plate 2 so that the electric contact portions 14 in every other insulating plate are superposed on each other.

The electric wire 10 is crimped on the crimping terminal 3 held in the insulating plate 2. In this state, the insulating plates 2 in parallel to each other are stacked. Further, the connecting bars 4 are inserted into the cylinder holes of the electric contact portions 14, respectively. Thus, the wiring unit serving as a wiring plate used in e.g. an electric connecting box is completed.

In accordance with this embodiment, the electric contact portions 14 of the crimping terminals 3 held in the adjacent upper and lower plates of the insulating plates 2 stacked successively are not superposed on each other. Therefore, the thickness of the insulating plate 2 can be decreased to the height h of the electric-wire connecting potion 13 which is thinner than the height H (FIG.2) of the electric contact portion 14. Namely, in this case also, the insulating plates can be surely stacked. For this reason, the wiring unit can be miniaturized.

The electric contact portion 14 held in the lower insulating plate 2 can invade the accommodating portion 6 through the through-hole 7 of the upper insulating plate 2.

Therefore, where the thickness of the insulating plate 2 is decreased to the height h of the electric-wire connecting potion 13 which is thinner than the height H (FIG.2) of the electric contact portion 14, the insulating plates 2 can be surely stacked. This contributes to miniaturization of the wiring unit.

Embodiment 2

Now referring to FIGS. 4 and 5, an explanation will be given of the wiring unit 1 according to the second embodiment of this invention. In this embodiment, like reference numerals refer to like elements in the first embodiment.

Figure 4:
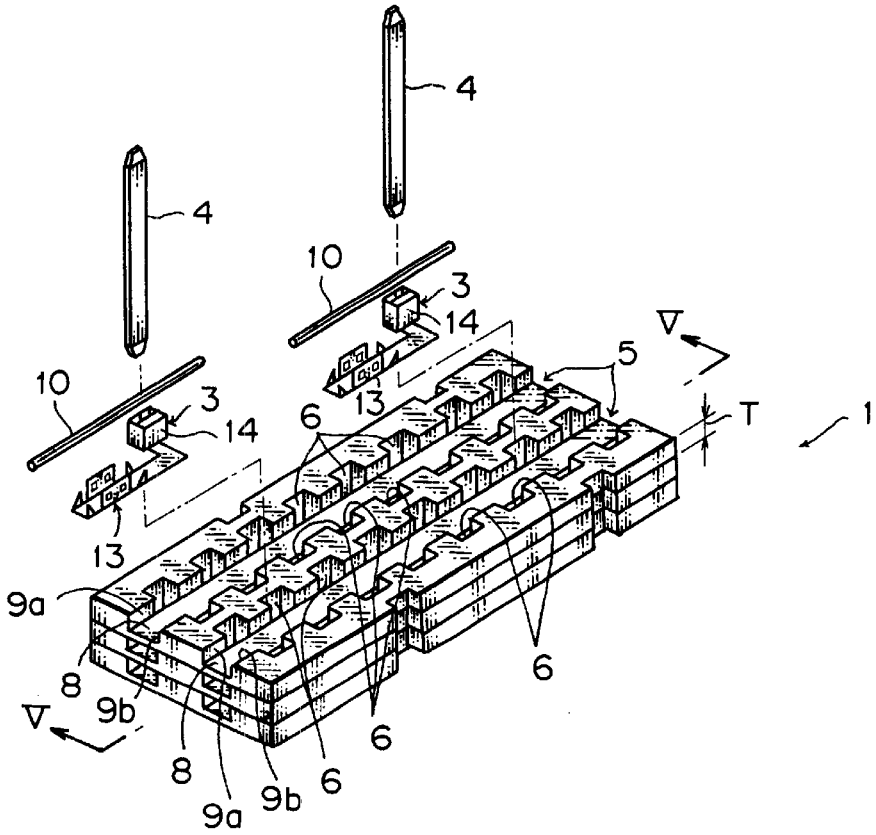
FIG. 4 is a perspective view of a wiring unit according to a second embodiment of this invention.
Figure 5:
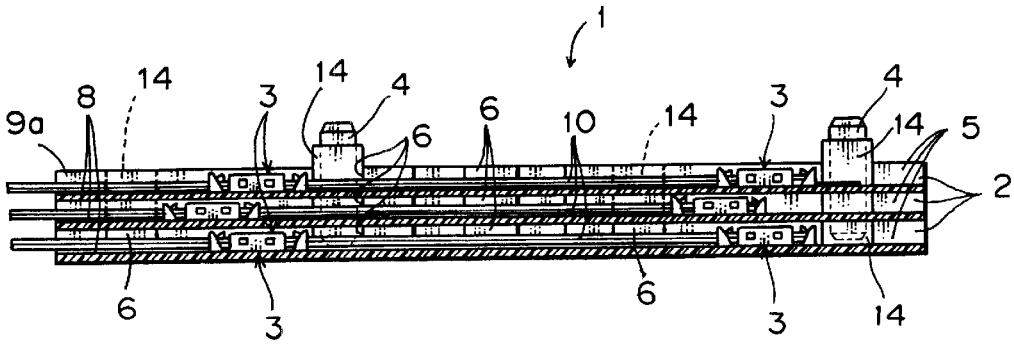
FIG. 5 is a sectional view taken in line V—V in FIG. 4.
Figure 8:
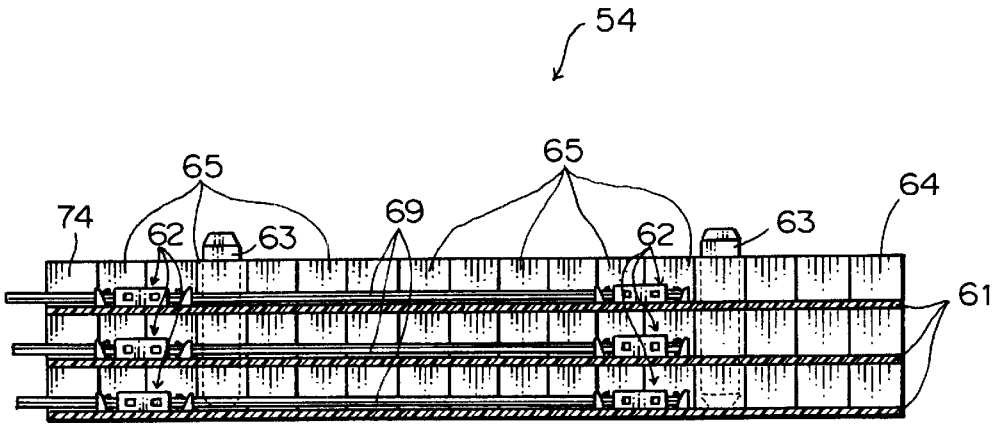
FIG. 8 is a sectional view taken in line VIII—VIII in FIG. 6.
Figure 6:
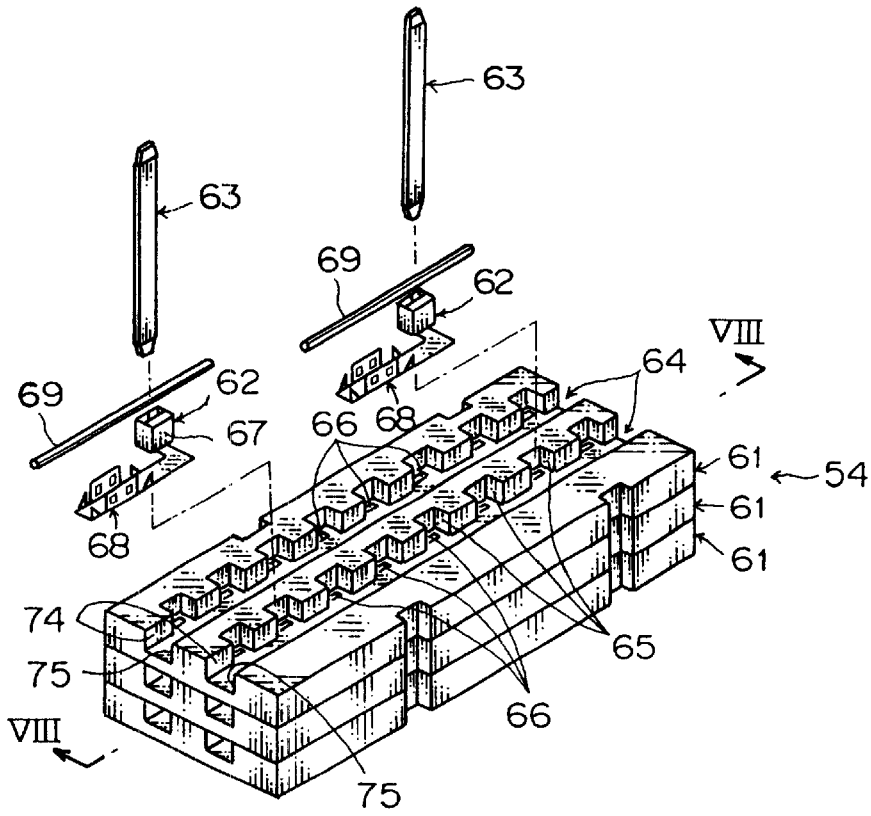
FIG. 6 is a perspective view of a conventional wiring unit.
Figure 7:
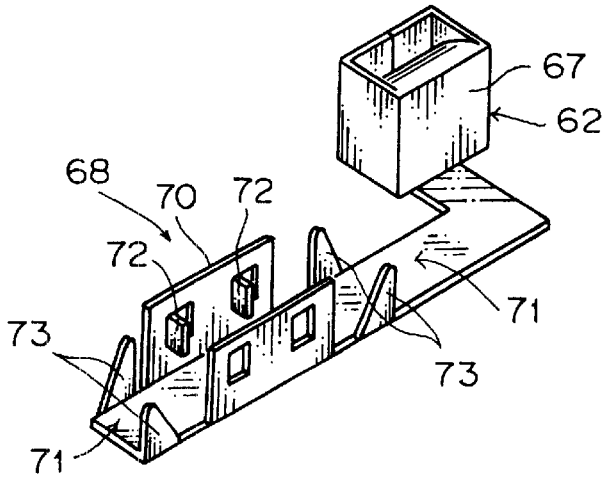
FIG. 7 is a perspective view of the wiring unit shown in FIG. 6.

In the insulating plate 2 of the wiring unit 1 according to this embodiment, as seen from FIG. 4, accommodating portions 6 are formed on both walls 9*a* and 9*b* thereof. In order that the crimping terminal 3 is held by the insulating plate 2, as seen from FIG. 5, the electric contact portions 14 are accommodated by the accommodating portions 6 formed on the different walls 9*a* and 9*b* of the insulating plates superposed successively. Therefore, the respective electric contact portions 14 of the crimping terminals 3 are surely prevented from being superposed with one another.

In this case also, it is permitted that the electric connecting portions 13 are superposed. Therefore, limitation to the circuit design of the wiring unit 1 can be relaxed.

In this embodiment, in the one insulating plate of the insulating plates superposed successively, the electric contact portion 14 is accommodated in the concaved accommodating portion 6 through the one wall 9*a*, whereas in the other insulating plate thereof, the electric portion 14 is accommodated in the concaved accommodating portion 6 through the other wall 9*b*. Thus, the electric contact portions 14 of the crimping terminals 3 held in the upper and lower insulating plates 2 can be surely prevented from being superposed on each other.

Therefore, even where the thickness of the insulating plate 2 is decreased to the height h of the electric-wire connecting potion 13 which is thinner than the height H of the electric contact portion 14, the insulating plates 2 can be surely stacked. This contributes to miniaturization of the wiring unit.

What is claimed is:

1. A wiring unit comprising:

a plurality of crimping terminals; and a plurality of insulating plates for holding said crimping terminals, wherein said crimping terminals each includes an electric-wire connecting portion on which an electric wire is crimped and an electric contact portion arranged to be connected to an electric contact portion of another crimping terminal with use of a connecting means, and said plurality of insulating plates are stacked successively, and the crimping terminals each is held in each of the insulating plates so that the electric contact portions in at least every other insulating plate are superposed.

2. A wiring unit according to claim 1, wherein said insulating plates each has a through-hole which the electric contact portion of said crimping terminal held in an adjacent insulating plate can enter when the insulating plates are stacked successively.

3. A wiring unit according to claim 1, wherein said electric-wire connecting portion crimps said electric wire in a state extended in a first direction, and said electric contact portion is arranged in a second direction orthogonal to said first direction, and said plurality of insulating plates each includes a terminal groove for accommodating said crimping terminals in a state where they are arranged side by side in said first direction, and accommodating portions which are formed in concave from a pair of opposite wall surfaces constituting said terminal groove and which can accommodate said electric contact portions, respectively.

* * * * *